US009281604B2

(12) United States Patent
Zhang et al.

(10) Patent No.: US 9,281,604 B2
(45) Date of Patent: Mar. 8, 2016

(54) ELECTRICAL CONNECTOR WITH AN INSULATING HOUSING FIRMLY ENGAGED WITH A SHELL AND A SPACER

(71) Applicant: Drapho Electronics Technology Co., Ltd., Kunshan, Jiangsu (CN)

(72) Inventors: Ming Zhang, Jiangsu (CN); Zhihong Fang, Jiangsu (CN); Zhuping Wu, Jiangsu (CN)

(73) Assignee: DRAPHO ELECTRONICS TECHNOLOGY CO., LTD., Kunshan, Jiangsu (CN)

( * ) Notice: Subject to any disclaimer, the term of this patent is extended or adjusted under 35 U.S.C. 154(b) by 60 days.

(21) Appl. No.: 14/282,903

(22) Filed: May 20, 2014

(65) Prior Publication Data

US 2015/0087189 A1 Mar. 26, 2015

(30) Foreign Application Priority Data

Sep. 26, 2013 (CN) ..... 2013 2 0596510 U

(51) Int. Cl.

| | |
|---|---|
| ***H01R 24/00*** | (2011.01) |
| ***H01R 13/506*** | (2006.01) |
| ***H01R 13/41*** | (2006.01) |
| *H01R 12/72* | (2011.01) |
| *H01R 13/6581* | (2011.01) |

(52) U.S. Cl.

CPC ..... *H01R 13/506* (2013.01); *H01R 13/41* (2013.01); *H01R 12/724* (2013.01); *H01R 13/6581* (2013.01)

(58) Field of Classification Search

CPC . H01R 23/7073; H01R 23/02; H01R 23/6873

USPC ..... 439/660, 607.4

See application file for complete search history.

(56) References Cited

U.S. PATENT DOCUMENTS

| | | | | |
|---|---|---|---|---|
| 7,549,896 | B2 * | 6/2009 | Zhang | H01R 12/716 439/607.01 |
| 8,535,097 | B2 * | 9/2013 | Yen | H01R 12/724 439/607.27 |
| 8,882,540 | B2 * | 11/2014 | Yen | H01R 27/00 439/489 |
| 8,882,542 | B2 * | 11/2014 | Song | H01R 23/6873 439/607.4 |
| 8,944,848 | B1 * | 2/2015 | Yu | 439/607.01 |
| 2010/0210124 | A1 * | 8/2010 | Li | H01R 23/6873 439/108 |
| 2012/0231661 | A1 * | 9/2012 | Song | H01R 23/6873 439/607.4 |
| 2012/0231675 | A1 * | 9/2012 | Zhang | H01R 13/6594 439/682 |

* cited by examiner

*Primary Examiner* — Hae Moon Hyeon

(74) *Attorney, Agent, or Firm* — Locke Lord LLP; Tim Tingkang Xia, Esq.

(57) ABSTRACT

An electrical connector includes an insulating housing, a shell retained on the insulating housing, a plurality of terminals retained on the mating portion of the insulating housing, and a spacer engaging with the insulating housing. The insulating housing includes a base portion and a mating portion protruding from the base portion, the base portion has a top wall, a bottom wall, a pair of sidewalls connecting with the top wall and bottom wall, a front wall connecting with the mating portion and a rear wall. The front wall of the base portion has a pair of slanted portions formed on two sides of the mating portion, the rear wall of the base portion has a plurality of barriers for retaining the terminals and a pair of flange portions on two sides of the barriers, each flange portion has a groove on an inner side surface to engage with the spacer.

7 Claims, 3 Drawing Sheets

ELECTRICAL CONNECTOR WITH AN INSULATING HOUSING FIRMLY ENGAGED WITH A SHELL AND A SPACER

CROSS-REFERENCE TO RELATED APPLICATIONS

This application claims priority under 35 U.S.C. §119 to People's Republic of China Patent Application 201320596510.0 entitled "An electrical connector" filed Sep. 26, 2013.

FIELD OF THE INVENTION

The present invention relates generally to electrical connection, and more particularly to electrical connectors.

BACKGROUND

An electrical connector is a component with high precision and used for electrically mating with a coupled electrical connector so that the electrical signal can be transmitted therebetween, thus, electrical connectors are widely used in electrical fields such as a computer which contains kinds of connectors like USB connector, D-Sub connector, RJ-45 connector etc.

Traditionally, an electrical connector normally includes an insulating housing and a plurality of terminals retained in the insulating housing. In order to improve the quality of signal transmission, said electrical connector may further includes a metal shell which covers on said insulating housing to realize EMI Shielding. Moreover, in order to assemble to electrical connector onto a PCB (printed circuit board) precisely without movement of terminal soldering tail, the insulating housing normally includes a spacer located behind the insulating housing for retaining the soldering tails of the terminals. As a carrier, the insulating housing retains the terminals and the metal shell firmly and also engages with the spacer. As the insulating housing is made of plastic materials and having a small size, the engagement between the insulating housing and the metal shell or spacer requires enough retaining force to ensure the stability of the connection if mating frequently, however, the insulating housing of a conventional electrical connector lacks of effective and simple structures to retain the metal shell and the spacer firmly.

Thus, it is necessary to provide a new type electrical connector to solve the problems mentioned above.

SUMMARY OF THE INVENTION

Accordingly, an object of the present invention is to provide an electrical connector with a new type of insulating housing which can firmly engage with the shell and the spacer and meet the requirements of frequent mating.

In order to achieve the object set forth, an electrical connector in accordance with the present invention comprises an insulating housing including a base portion and a mating portion protruding from said base portion, said base portion including a top wall, a bottom wall, a pair of sidewalls connecting with said top wall and bottom wall, a front wall connecting with said mating portion and a rear wall; a shell retained on said insulating housing; a spacer engaging with said rear wall of the insulating housing; a plurality of terminals retained on said mating portion of said insulating housing; wherein said front wall of the base portion has a pair of slanted portions formed on two sides of said mating portion, said rear wall of the base portion has a plurality of barriers for retaining said terminals and a pair of flange portions on two sides of said barriers, each flange portion has a groove on an inner side surface to engage with said spacer.

Other objects, advantages and novel features of the invention will become more apparent from the following detailed description when taken in conjunction with the accompanying drawings.

DETAILED DESCRIPTION

Figure 1:
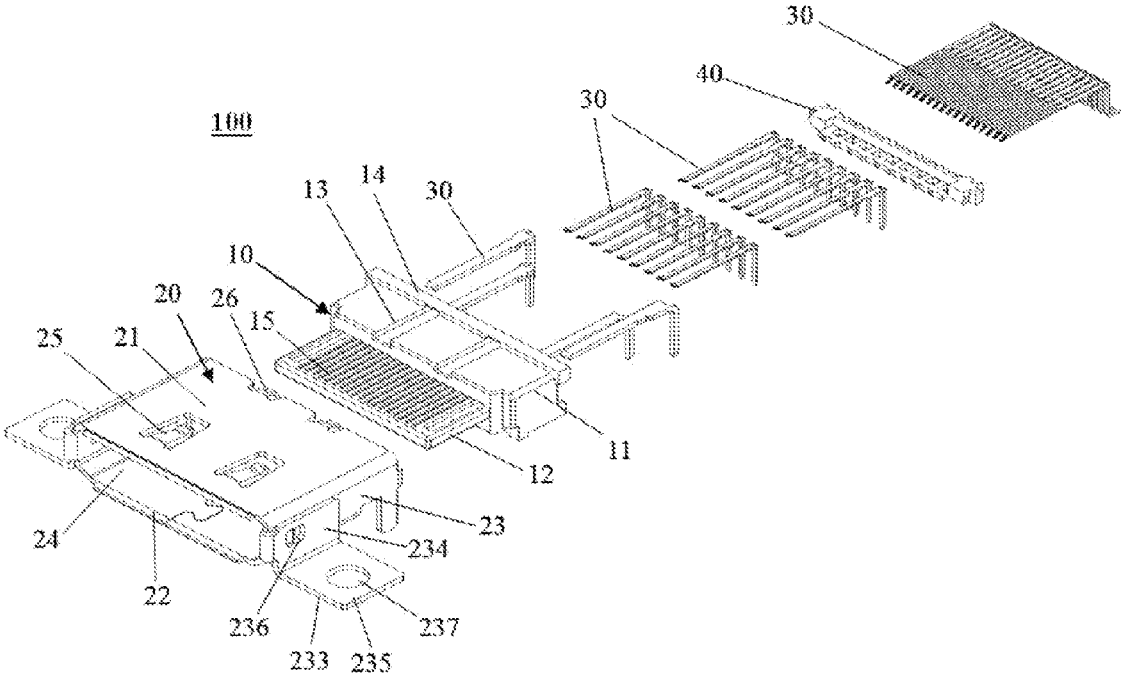
FIG. 1 is an exploded, perspective view of an electrical connector of the present invention.
Figure 2:
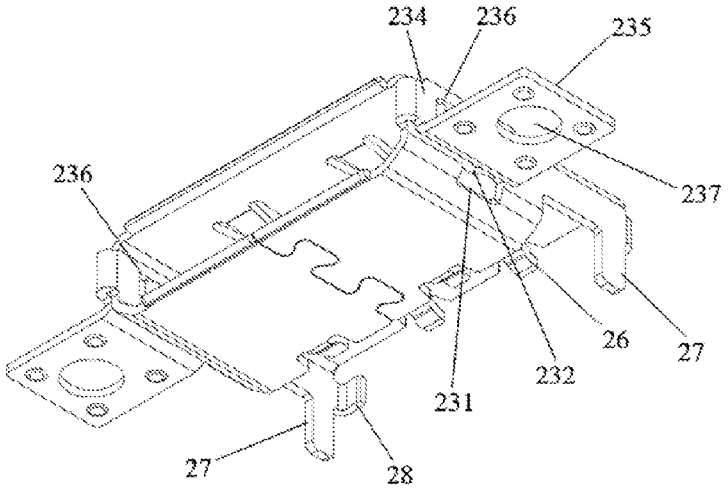
FIG. 2 is a perspective view of a shell of an electrical connector of the present invention.
Figure 3:
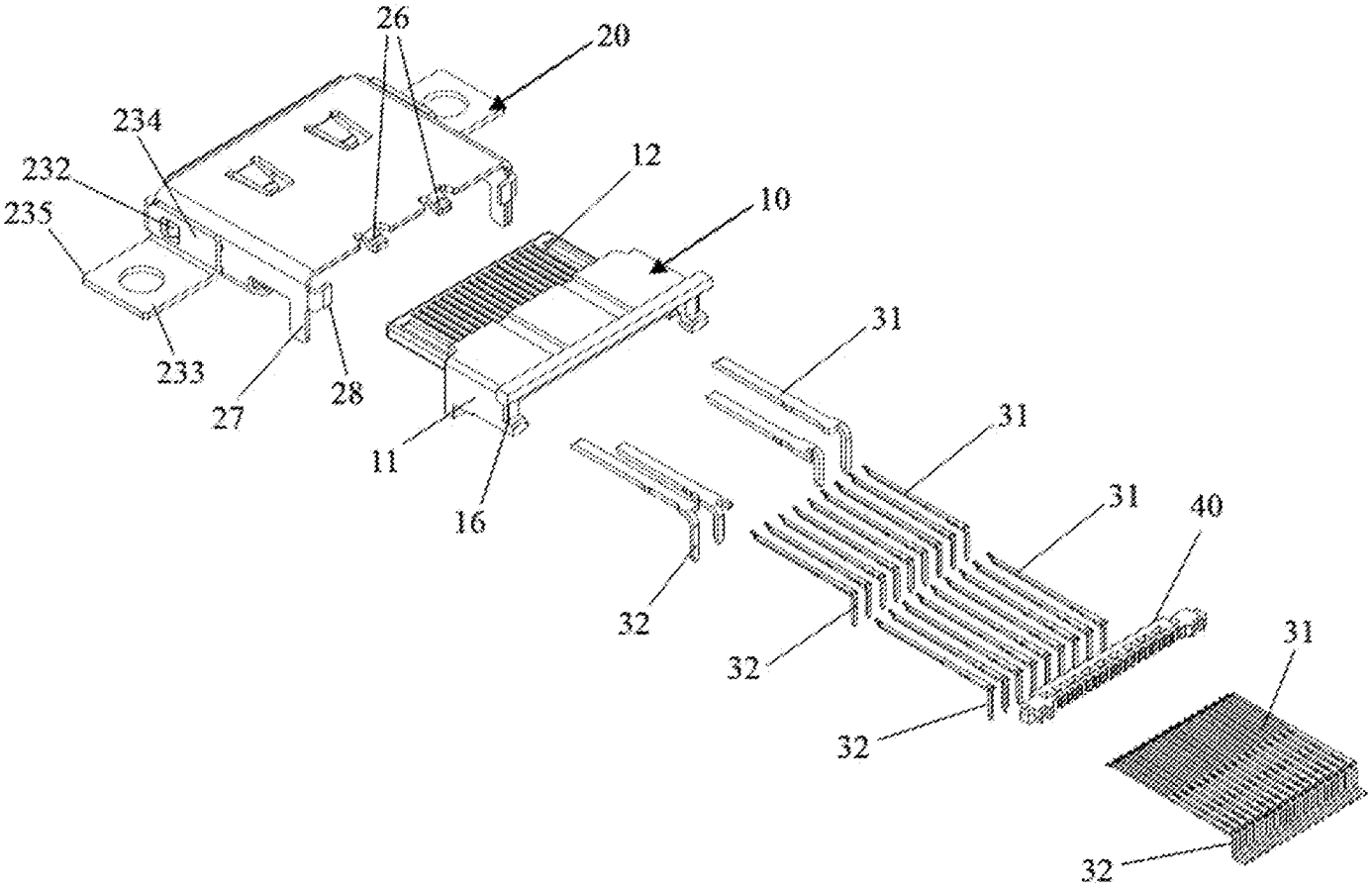
FIG. 3 is another exploded, perspective view of an electrical connector of the present invention.

Reference will now be made in detail to the preferred embodiment of the present invention.

As referring to FIG. 1 to FIG. 4, the present invention provides an electrical connector 100. The electrical connector 100 includes an insulating housing 10, a shell 20 retained on said insulating housing 10, and a plurality of terminals 30 received in said insulating housing 10, and a spacer 40 for retaining said terminals 30. Said electrical connector 100 is used for mating with a coupled electrical connector (not shown) along a mating direction to realize signal transmission.

Figure 4:
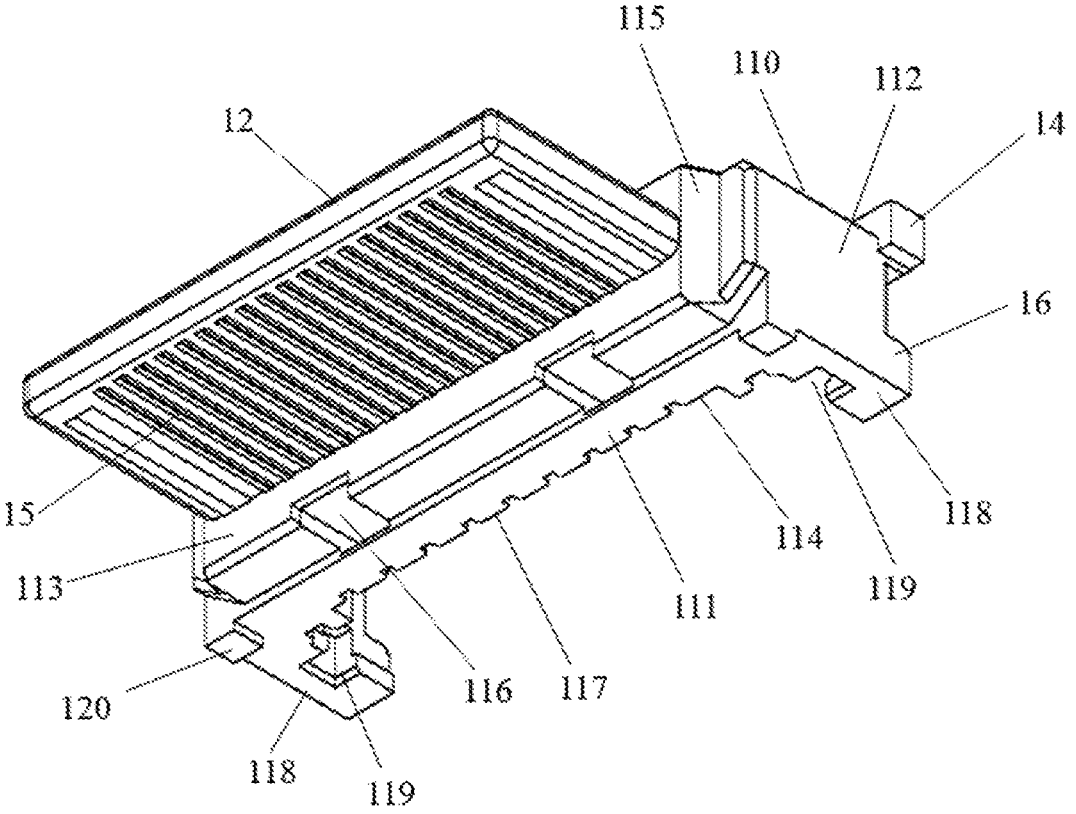
FIG. 4 is a perspective view of an insulating housing of an electrical connector of the present invention.

Said insulating housing 10 includes a base portion 11 and a mating portion 12 protruding from said base portion 11. Said base portion 11 has a pair of engaging slots 13 which are parallel to each other and a protruding portion 14 formed on an end of said engaging slots 13, moreover, the end of said engaging slot 13 further extends into said protruding portion 14. Said mating portion 12 is plate-like with a top surface and bottom surface each of which defines a plurality of passageways 15 for receiving said terminals 30, said passageway 15 extends parallel to said engaging slot 13. As shown in FIG. 4, said base portion 11 has a top wall 110, a bottom wall 111, a pair of sidewalls 112 connecting with said top wall 110 and bottom wall 111, a front wall 113 connecting with said mating portion 12, and a rear wall 114 engaging with said spacer 40. Said engaging slots 13 are formed on said top wall 110, the protruding portion 14 extends perpendicular to the engaging slots 13 and protrudes upwardly from said top wall 110 to get closer to a backside of the base portion 11. Said front wall 113 has a pair of slanted portions 115 which are formed on two sides of said mating portion 12 for conveniently mating with a coupled electrical connector. Furthermore, said bottom wall 111 of the base portion 11 defines a pair of inserting slots 116 for retaining with said shell 20 firmly. Said rear wall 114 has a plurality of barriers 117 for retaining said terminals 30 and a pair of flange portions 118 on two sides of said barriers 117 to retain said spacer 40 firmly. Said two flange portion 118 defines a pair of grooves 119 on an inner side surface for engaging with said spacer 40. Said bottom wall 111 further has a pair of locking posts 120 engaging with said shell 20.

Said shell 20 is made of metal which are formed by stamping process and then bended into a unitary body. Said shell 20 has a top plate 21, a bottom plate 22 parallel to said top plate 21, and a pair of side plates 23 connecting with said top plate 21 and the bottom plate 22, said top plate 21, bottom plate 22, side plates 23 together define a receiving room 24 for receiving a coupled electrical connector. Said top plate 21 has a pair of elastic tabs 25 protruding into said receiving room 24 and a pair of locking tabs 26 formed on a backside of said elastic tabs 25. Said elastic tabs 25 are used to connect with a shell member of said couple electrical connector to form a ground circuit, and said two elastic tabs 25 are correspond to said two engaging slots 13 respectively and located on an upper side of said engaging slots 13. Said locking tabs 26 extend from a rear edge of said top plate 21 for inserting into said protruding portion 14 along said engaging slots 13 so that the shell 20 can be firmly retained on the insulating housing 10. Each side plate 23 has a hole 231, a bending tab 232 inside the hole 231, and a retaining portion 233 outside the hole 231, said retaining portion 233 is bended and extends backwardly from a front edge of the side plate 23, moreover, said retaining portion 233 includes a vertical portion 234 and a horizontal portion 235 which is bended and extending from a bottom of said vertical portion 234. Said vertical portion 234 is parallel to an outer surface of said side plate 23 and includes an opening 236 correspond to said hole 231 in order to receive the bending tab 232. Said horizontal portion 235 is rectangular and has a circular retaining aperture 237, in a preferred embodiment of the present invention, said retaining aperture 237 engages with a fixation component such as a screw bolt so that the retaining portion 233 can be mounted onto a PCB.

Additionally, in order to strengthen the connection between said shell 20 and the PCB, said shell 20 in present invention further includes a pair of locking legs 27 which engages with the PCB by Through-Hole soldering technology. Said locking leg 27 extends downwardly from a bottom edge of said side plate 23. A bending leg 28 is formed on one side of said locking leg 27 and extending inwardly to lock with a backside of the base portion 11. Said base portion 11 of the insulating housing 10 has a pair of step portions 16 engaging with said bending legs 28, which improves the retaining force between the shell 20 and the insulating housing 10.

Said terminal 30 is L-shaped and has a horizontal arm 31 and a vertical arm 32. Said vertical arm 32 is vertically bended from an end of said horizontal arm 31 in order to engage with said spacer 40, which can prevent the vertical arms 32 from moving away during the process of soldering on the PCB.

To sum up, the electrical connector 100 of the present invention provides an insulating housing 10 with modified structures which can engage with the shell 20 firmly by using inserting slots 116, locking posts 120 and step portions 116. Meanwhile, the insulating housing 10 also can engage with the spacer 40 firmly by using the structures of flange portions 118 and grooves 119, which ensures a stable connection with enough retaining force between the insulating housing 10, the shell 20 and the spacer 40 even under a condition of frequent mating. Moreover, by using the slanted portions 115, the electrical connector may match with a coupled electrical connector smoothly.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the following claims and the principles and novel features disclosed herein.

What is claimed is:

1. An electrical connector, comprising:

an insulating housing including a base portion and a mating portion protruding from said base portion, said base portion including a top wall, a bottom wall, a pair of sidewalls connecting with said top wall and bottom wall, a front wall connecting with said mating portion and a rear wall;

a shell retained on said insulating housing;

a spacer engaging with said rear wall of the insulating housing;

a plurality of terminals retained on said mating portion of said insulating housing;

wherein said front wall of the base portion has a pair of slanted portions formed on two sides of said mating portion, said rear wall of the base portion has a plurality of barriers for retaining said terminals and a pair of flange portions on two sides of said barriers, each flange portion has a groove on an inner side surface to engage with said spacer;

wherein said bottom wall of the base portion defines a pair of inserting slots for retaining said shell, said rear wall of the base portion has a pair of step portions engaging with said shell; and wherein said base portion has a pair of engaging slots formed on said top wall and a protruding portion formed on an end of said engaging slots, said engaging slots extend into said protruding portion.

2. The electrical connector according to claim 1, wherein said protruding portion extends perpendicular to the engaging slots and protrudes upwardly from said top wall, said protruding portion is formed on a rear side edge of said top wall.

3. The electrical connector according to claim 2, wherein said shell has a top plate which includes a pair of elastic tabs and a pair of locking tabs formed on a backside of said elastic tabs, said locking tabs engage into said protruding portion along said engaging slots.

4. The electrical connector according to claim 3, wherein said shell has a side plate and a retaining portion bended backwardly from a front edge of the side plate, said retaining portion has a vertical portion and a horizontal portion bended from a bottom edge of said vertical portion, said vertical portion is parallel to an outer surface of said side plate and includes an opening.

5. The electrical connector according to claim 4, wherein said side plate of the shell has a hole corresponding to said opening of the side plate and a bending tab inside the hole.

6. The electrical connector according to claim 5, wherein said shell has a pair of bending legs retained on said step portions of the insulating housing.

7. The electrical connector according to claim 6, wherein said bottom wall further has a pair of locking posts.

* * * * *